US011787179B2

(12) United States Patent
Nakashima et al.

(10) Patent No.: US 11,787,179 B2
(45) Date of Patent: Oct. 17, 2023

(54) PLASMA ELECTRON BEAM TREATMENT INKJET PRINTING DEVICE

(71) Applicant: SAKATA INX CORPORATION, Osaka (JP)

(72) Inventors: Okinori Nakashima, Osaka (JP); Takuya Myose, Osaka (JP); Jun Kinjoh, Osaka (JP); Daigo Shiozaki, Osaka (JP)

(73) Assignee: SAKATA INX CORPORATION, Osaka (JP)

( * ) Notice: Subject to any disclaimer, the term of this patent is extended or adjusted under 35 U.S.C. 154(b) by 176 days.

(21) Appl. No.: 17/283,234

(22) PCT Filed: Oct. 11, 2019

(86) PCT No.: PCT/JP2019/040291
§ 371 (c)(1),
(2) Date: Apr. 6, 2021

(87) PCT Pub. No.: WO2020/080310
PCT Pub. Date: Apr. 23, 2020

(65) Prior Publication Data

US 2021/0347170 A1 Nov. 11, 2021

(30) Foreign Application Priority Data

Oct. 19, 2018 (JP) ..... 2018-197387

(51) Int. Cl.
*B41J 2/14* (2006.01)
*B41J 2/21* (2006.01)

(52) U.S. Cl.
CPC ..... *B41J 2/1433* (2013.01); *B41J 2/2103* (2013.01)

(58) Field of Classification Search
CPC ..... B41J 2/1433; B41J 2/2103
See application file for complete search history.

(56) References Cited

U.S. PATENT DOCUMENTS 5,477,784 A * 12/1995 Floegel ..... B41M 7/00 101/212
2006/0164487 A1 7/2006 Kadomatsu et al.
(Continued)

FOREIGN PATENT DOCUMENTS

DE 102010029939 A1 12/2011
JP 2002253952 A 9/2002
(Continued)

OTHER PUBLICATIONS

Extended European Search Report (EESR) dated Jul. 6, 2022, issued for European counterpart patent application No. EP19872292.8 (9 pages).
(Continued)

*Primary Examiner* — Jason S Uhlenhake
(74) *Attorney, Agent, or Firm* — Law Office of Katsuhiro Arai

(57) ABSTRACT

An inkjet printing device for multi-color printing includes: multi-color inkjet nozzles that move in the direction perpendicular to the moving direction of the target base printing material and also in the direction parallel to the surface of the target base printing material; plasma ejection ports provided downstream of the multi-color inkjet nozzles in a manner oriented facing the surface of the multiple colored inks printed on the target base printing material; and an electron beam irradiation part located on the downstream side of the inkjet nozzles and plasma ejection ports, in a manner oriented facing the printed surface of the target base printing material.

13 Claims, 4 Drawing Sheets

(56) References Cited

U.S. PATENT DOCUMENTS

| | | | | |
|---|---|---|---|---|
| 2010/0225696 | A1* | 9/2010 | Shibata | B41J 2/19 347/17 |
| 2015/0030823 | A1 | 1/2015 | Stamatoukos et al. | |
| 2015/0251453 | A1 | 9/2015 | Nakai et al. | |
| 2017/0028742 | A1 | 2/2017 | Ohnishi | |
| 2018/0147831 | A1 | 5/2018 | Du Buf et al. | |
| 2018/0154576 | A1 | 6/2018 | Chen et al. | |
| 2019/0322107 | A1* | 10/2019 | Ozawa | B41J 2/01 |

FOREIGN PATENT DOCUMENTS

| | | | |
|---|---|---|---|
| JP | 2003200565 | A | 7/2003 |
| JP | 2003218099 | A | 7/2003 |
| JP | 2003300315 | A | 10/2003 |
| JP | 2003311940 | A | 11/2003 |
| JP | 2013129123 | A | 7/2013 |
| JP | 2015153652 | A | 8/2015 |
| JP | 2015180529 | A | 10/2015 |
| JP | 2017132895 | A | 8/2017 |
| JP | 2018094758 | A | 6/2018 |
| JP | 2018099871 | A | 6/2018 |
| JP | 6353618 | B1 | 7/2018 |
| JP | 2018140784 | A | 9/2018 |
| WO | 2011154184 | A2 | 12/2011 |
| WO | 2015093609 | A1 | 6/2015 |
| WO | 2018017058 | A1 | 1/2018 |
| WO | 2018105621 | A1 | 6/2018 |

OTHER PUBLICATIONS

Notification Concerning Transmittal of International Preliminary Report on Patentability (PCT/IB/326) and Notification of Transmittal of Translation of the International Preliminary Report on Patentability (PCT/IB/338) dated Apr. 15, 2021, with International Preliminary Report on Patentability (PCT/IB/373) and Written Opinion of the International Searching Authority (PCT/ISA/237), for corresponding international application PCT/JP2019/040291 (26 pages).

International Search Report (ISR) dated Jan. 7, 2020, issued for International application No. PCT/JP2019/040291. (2 pages).

A Notice of Reasons for Refusal issued by the Japanese Patent Office dated Jun. 7, 2022, for Japanese counterpart application No. 2018-197387. (3 pages).

A Notice of Reasons for Refusal issued by the Japanese Patent Office dated Dec. 20, 2022, for Japanese counterpart application No. 2018-197387. (2 pages).

* cited by examiner

[FIG. 1]
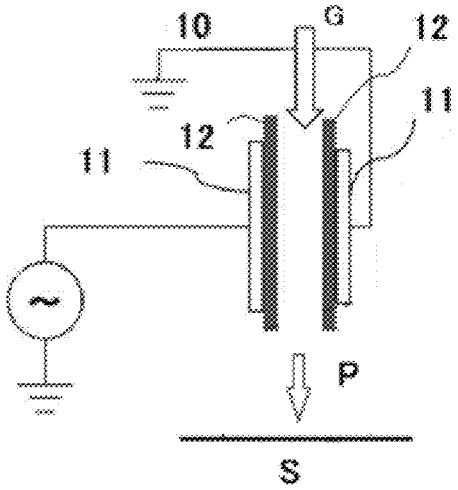
[FIG. 2-1]
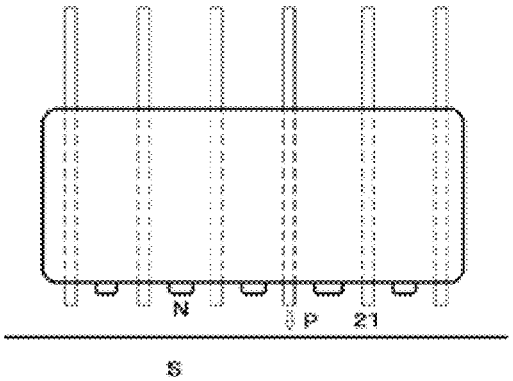
[FIG. 2-2]
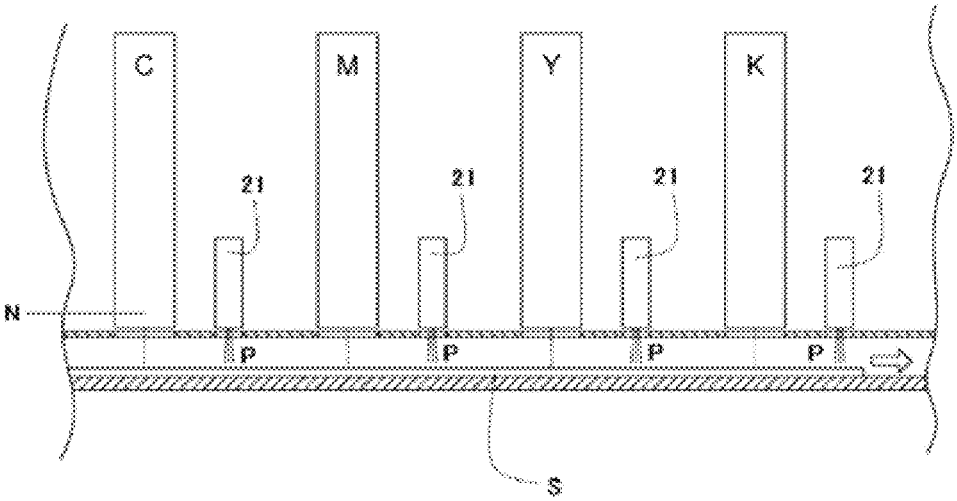

[FIG. 2-3]
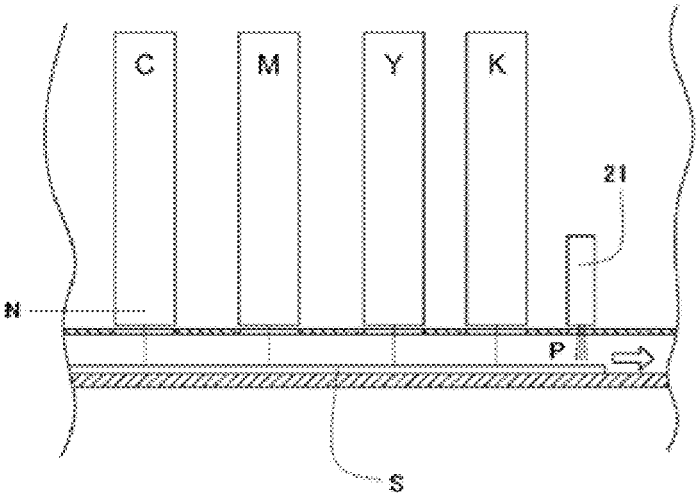
[FIG. 2-4]
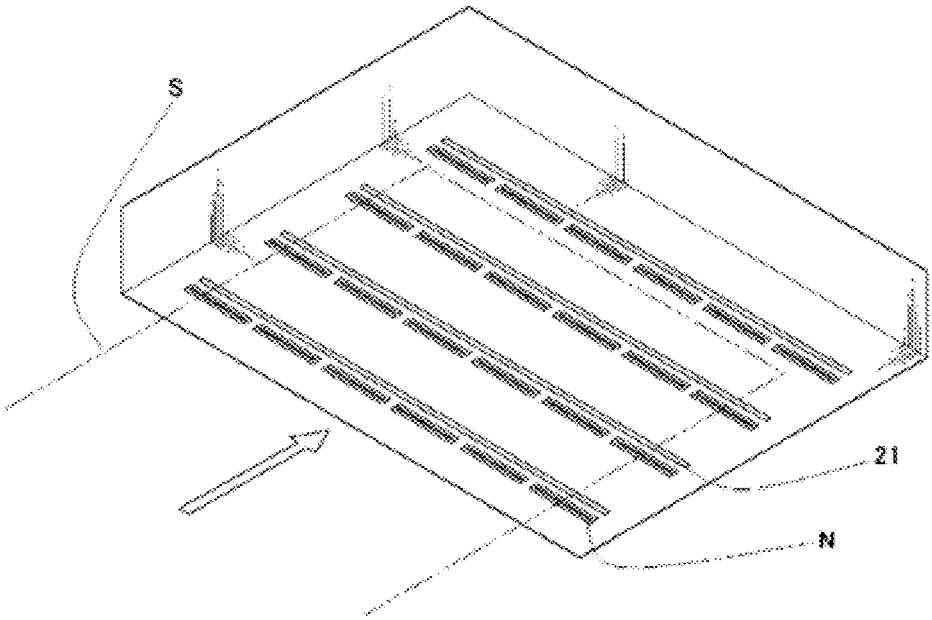

[FIG. 3-1]
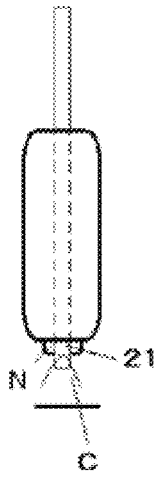
[FIG. 3-2]
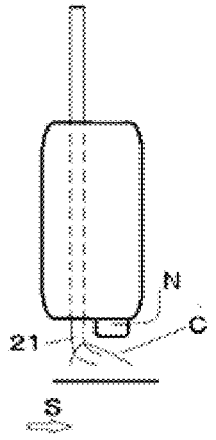
[FIG. 3-3]
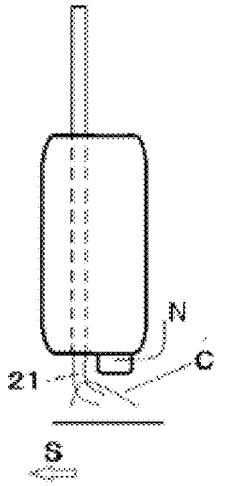

[FIG. 4]
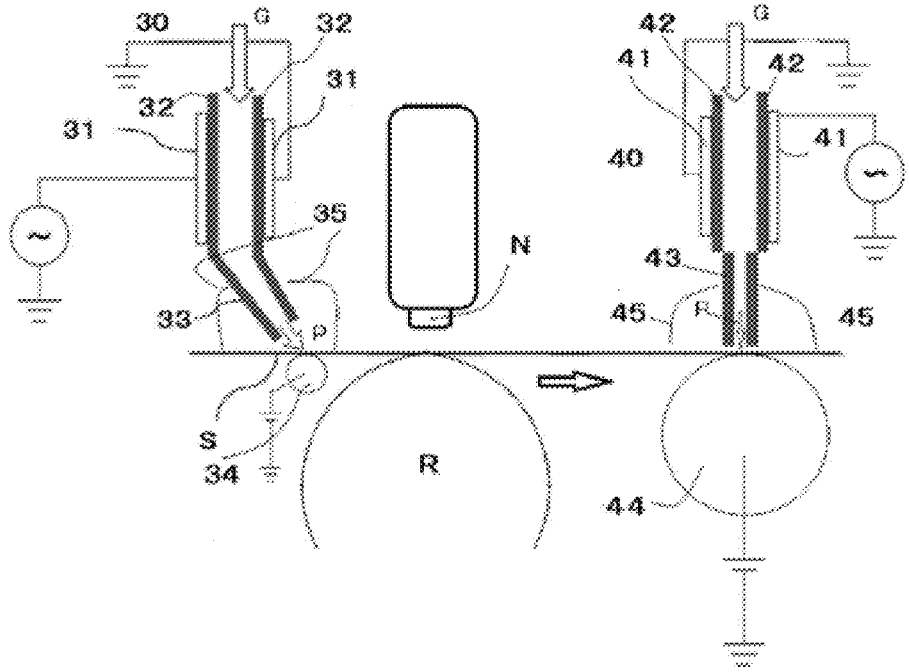
[FIG. 5]
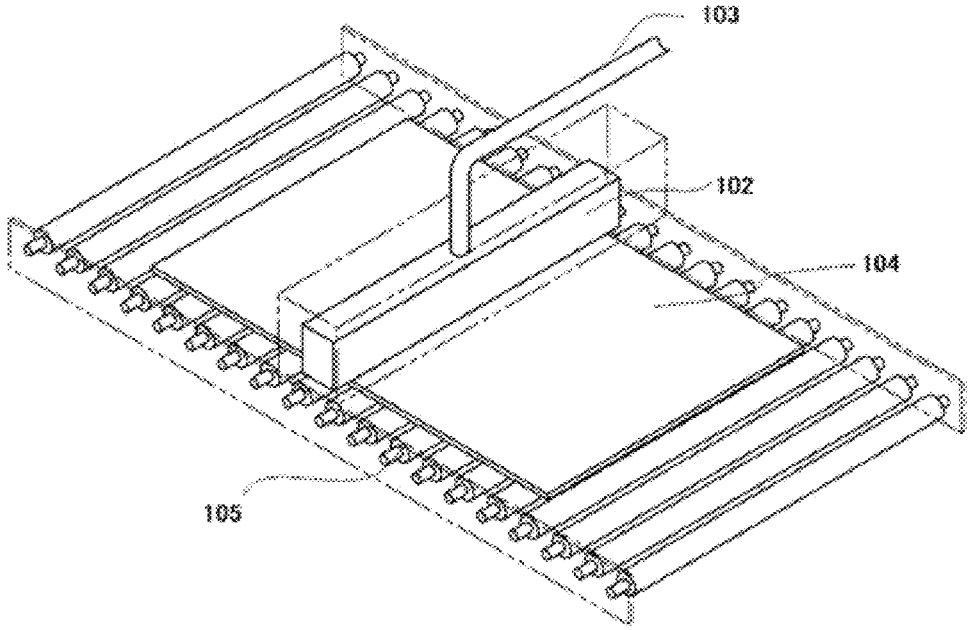

PLASMA ELECTRON BEAM TREATMENT INKJET PRINTING DEVICE

CROSS-REFERENCE TO RELATED APPLICATIONS

This application is the U.S. National Phase under 35 U.S.C. § 371 of International Application PCT/JP2019/040291, filed Oct. 11, 2019, which claims priority to Japanese Patent Application No. JP2018-197387, filed Oct. 19, 2018. The International Application was published under PCT Article 21(2) in a language other than English.

TECHNICAL FIELD

The present invention relates to an inkjet printing device.

BACKGROUND ART

As described in Patent Literature 1, an art of irradiating ultraviolet light at low oxygen concentration onto an ink on a target base printing material immediately after it has been inkjet-printed, to polymerize the surface layer of the ink, and then irradiating an electron beam (hereinafter also referred to as "EB") to polymerize the deep part and thereby cure the entirety of the ink, is known.

Also, as described in Patent Literature 2, an art of applying corona discharge treatment in an ambience of below 20000 ppm in oxygen concentration to an ink on a target base printing material immediately after it has been inkjet-printed, to polymerize the surface layer of the ink, and then irradiating an electron beam to polymerize its deep part and thereby cure the entirety of the ink, is known.

While these curing means reportedly do not require compounding of a photopolymerization initiator into the ink, they do require an ambience of low oxygen concentration.

The aforementioned background arts, while allowing an energy beam polymerizable ink containing no photopolymerization initiator to be cured without fail, still require a region of particularly low oxygen concentration to be formed. Particularly in the case of the invention described in Patent Literature 1, ultraviolet light may have to be irradiated after all, which makes it difficult, in practice, to cure the surface layer of the energy beam-curable ink containing no photopolymerization initiator.

Furthermore, in the case of using corona discharge treatment, performing the treatment in a stable manner is difficult unless the distance between the electrodes is sufficiently reduced to around several millimeters. In this case, depending on the thickness of the printing paper and degree of vertical movement of the printing paper, the printed ink may contact the electrodes before its surface cures, and disturb the printing as a result. Also, depending on the intensity of corona discharge treatment, the surface of the paper or other target base printing material may change its property where the ink is not deposited.

BACKGROUND ART LITERATURE

Patent Literature

Patent Literature 1: Japanese Patent Laid-open No. 2017-132895

Patent Literature 2: Japanese Patent No. 6353618

SUMMARY OF THE INVENTION

Problems to be Solved by the Invention

An object of the present invention is to obtain a device that allows the ink used in printing to be cured without fail, even when it contains no photopolymerization initiator, without modifying the property of the surface of the target base printing material.

Means for Solving the Problems

As a result of studying in earnest to achieve the aforementioned object, the inventors of the present invention completed the invention as described below.

1. An inkjet printing device, which is for multi-color printing, comprising:
   multi-color inkjet nozzles that move in a direction perpendicular to a moving direction of a target base printing material and also in a direction parallel to the surface of the target base printing material;
   plasma ejection ports provided downstream of the multi-color inkjet nozzles in a manner oriented facing the surface of the multiple colored inks printed on the target base printing material; and
   an electron beam irradiation part located on a downstream side of the inkjet nozzles and plasma ejection ports, in a manner oriented in the moving direction of the target base printing material.
2. The inkjet printing device according to 1, comprising:
   an inkjet printing part comprising:
   the multi-color inkjet nozzles that move in the direction perpendicular to the moving direction of the target base printing material and also in the direction parallel to the surface of the target base printing material; and
   the plasma ejection ports independent of the inkjet nozzles; and
   the electron beam irradiation part located on the downstream side, in the moving direction of the target base printing material, of the inkjet printing part.
3. The inkjet printing device according to 2, wherein a head equipped with each of multi-color inkjet nozzles has the plasma ejection port on the downstream side of the inkjet nozzle.
4. The inkjet printing device according to 2 or 3, wherein the inkjet printing device is for multi-color printing, a head is constituted for each inkjet nozzle assigned to each color, and a/the head having a plasma ejection port is provided downstream of each head having such inkjet nozzle assigned to each color.
5. The inkjet printing device according to any one of 2 to 4, wherein an opening part of the plasma ejection port is not oriented facing the surface of the target base printing material.
6. The inkjet printing device according to any one of 2 to 5, wherein the opening part of the plasma ejection port is oriented in the moving direction of the target base printing material so that the plasma ejected from the plasma ejection port is set to be oriented in the direction in which the target base printing material moves.
7. The inkjet printing device according to any one of 2 to 6, wherein a base material that is grounded or charged with negative electricity or positive electricity is placed, in the inkjet printing part, on the opposite side of the target base printing material as viewed from the plasma ejection port, and in contact with a non-printing surface side of the target base printing material.
8. The inkjet printing device according to any one of 2 to 7, having a cover for covering the plasma ejection port.
9. The inkjet printing device according to any one of 2 to 8, comprising:
   the inkjet printing part comprising the inkjet nozzle that moves in the direction perpendicular to the moving direction of the target base printing material and also in the direction parallel to the surface of the target base printing material;

a cover provided for covering the inkjet printing part;

the plasma ejection port provided in the cover; and the electron beam irradiation part located on the downstream side, in the moving direction of the target base printing material, of the inkjet printing part.

10. The inkjet printing device according to 9, wherein the opening part of the plasma ejection port is not oriented facing the surface of the target base printing material.

11. The inkjet printing device according to 9 or 10, wherein the opening part of the plasma ejection port is oriented in the moving direction of the target base printing material so that the plasma ejected from the plasma ejection port is set to be oriented in the direction in which the target base printing material moves.

12. The inkjet printing device according to any one of 9 to 11, wherein a base material that is grounded or charged with negative electricity or positive electricity is placed, in the inkjet printing part, on the opposite side of the target base printing material as viewed from the plasma ejection port, and in contact with the non-printing surface side of the target base printing material.

13. The inkjet printing device according to 1, comprising:

the inkjet printing part comprising the multi-color inkjet nozzles that move in the direction perpendicular to the moving direction of the target base printing material and also in the direction parallel to the surface of the target base printing material;

the plasma ejection port provided on the downstream side, in the moving direction of the target base printing material, of the inkjet printing part; and the electron beam irradiation part located on the downstream side, in the moving direction of the target base printing material, of the plasma ejection port.

14. The inkjet printing device according to 13, wherein the opening part of the plasma ejection port is not oriented facing the surface of the target base printing material.

15. The inkjet printing device according to 13 or 14, wherein the opening part of the plasma ejection port is oriented in the moving direction of the target base printing material so that the plasma ejected from the plasma ejection port is set to be oriented in the direction in which the target base printing material moves.

16. The inkjet printing device according to any one of 13 to 15, wherein a base material that is grounded or charged with negative electricity or positive electricity is placed on the opposite side of the target base printing material as viewed from the plasma ejection port and in contact with the non-printing surface side of the target base printing material.

17. The inkjet printing device according to any one of 13 to 16, having a cover for covering the plasma ejection port.

18. An inkjet printing device comprising:

inkjet nozzles of a line-head type for printing two or more colored inks; and plasma ejection ports, each provided for each color-specific nozzle on the downstream side in the moving direction of the target base printing material.

19. An inkjet printing device comprising:

inkjet nozzles of a line-head type for printing two or more colored inks; and plasma ejection ports, each provided for each set in the nozzles for printing two or more colors on the downstream side, in the moving direction of the target base printing material, as viewed from the line-head nozzle.

Effects of the Invention

According to the printing device proposed by the present invention, a device that can achieve inkjet-printed images having good cured film resistance by, after two or more colored inks have been printed, allowing the surface of the printed inks to be cured by atmospheric-pressure plasma and then irradiated with an electron beam (EB) and cured so that the ink dots will be cured without fail both on the surface and inside, is obtained.

Also, the device can achieve images having good cured film resistance because, when atmospheric-pressure plasma is irradiated after each color has been printed and an electron beam (EB) is irradiated after all colors have been printed, the dots of different colored inks will not smudge even when overlaid and thus high-quality images can be achieved as a result, while the dots will also be cured without fail both on the surface and inside.

In addition, the device irradiates atmospheric-pressure plasma to actively cure inks, while also preventing the paths of inks from being disturbed or the shapes of printed inks from being disturbed by air flows on the target printing surface.

BRIEF DESCRIPTION OF THE DRAWINGS

FIG. 1 A schematic view of a cross-section of a remote atmospheric-pressure plasma irradiation part.

FIG. 2-1 A drawing in which inkjet nozzles are provided as one piece with plasma ejection ports.

FIG. 2-2 A drawing in which inkjet nozzles are provided as one piece with plasma ejection ports.

FIG. 2-3 A drawing in which inkjet nozzles are provided as one piece with a plasma ejection port.

FIG. 2-4 A drawing in which inkjet nozzles are provided as one piece with plasma ejection ports.

FIG. 3-1 A drawing in which an inkjet nozzle is provided as one piece with a plasma ejection port.

FIG. 3-2 A drawing in which an inkjet nozzle is provided as one piece with a plasma ejection port.

FIG. 3-3 A drawing in which an inkjet nozzle is provided as one piece with a plasma ejection port.

FIG. 4 A drawing in which an inkjet nozzle is provided separately from plasma ejection ports.

FIG. 5 A drawing showing only a plasma ejection device, wherein an inkjet nozzle is provided separately from a plasma ejection port.

DESCRIPTION OF THE SYMBOLS

10—Atmospheric-pressure plasma irradiation device
11—A pair of electrodes
12—Insulator body
21—Plasma ejection port
30—Front-end atmospheric-pressure plasma treatment device
31—A pair of electrodes
32—Insulator body
33—Plasma ejection tube
34—Backup roller
35—Cover
40—Plasma treatment device

41—A pair of electrodes
42—Insulator body
43—Plasma ejection tube
44—Backup roller
45—Cover
G—Plasma generation gas
P—Atmospheric-pressure plasma
S—Target base printing material
N—Inkjet nozzle
C—Cover
R—Backup roller

MODE FOR CARRYING OUT THE INVENTION

The device proposed by the present invention is explained in detail below.

<Inkjet Printing Part>

For the inkjet printing part under the present invention, a structure comprising any of various known inkjet nozzles for printing inks of two or more colors, or a structure comprising a nozzle conforming to any known inkjet method, may be adopted.

And, for the inkjet printing part, which prints on coated paper, plain paper, various resin films, laminate films having metal layers and metal compound layers, and other known target base printing materials that can be inkjet-printed, one based on any known operating principle may be adopted.

Such inkjet printing part may be fitted with an inkjet nozzle head in such a way that it moves in the direction perpendicular to the moving direction of the target base printing material and in the direction parallel to the surface of the target base printing material, or may have a fixed inkjet nozzle like a line-head type.

Here, it should be noted that, while the target base printing material to be conveyed can be supported with backup rollers that turn at a constant speed, backup rollers need not be provided.

The inkjet nozzle, or nozzles, is/are constituted by one or more nozzles corresponding to one or more colors. Printing data is calculated to obtain an accurate printing location for each color (location at which the ink is ejected from each nozzle), after which an ejection timing for each colored ink from each inkjet nozzle is obtained to allow for printing at this printing location, and inkjet printing is performed based on this calculation result.

(Plasma Ejection Port (Provided as One Piece with Inkjet Nozzle Head)

The plasma ejection port under the present invention is designed to introduce atmospheric-pressure plasma formed by the atmospheric-pressure plasma irradiation device 10 shown in FIG. 1, and irradiate the atmospheric-pressure plasma to cure the surface of ink dots printed on the target base printing material.

The atmospheric-pressure plasma irradiation device 10 shown in FIG. 1 uses a plasma treatment device comprising a discharge space with an outlet, and a pair of discharge electrodes 11 with insulator bodies 12 facing each other over a spacing of approx. 0.5 to 5.0 mm so that they can generate an electric field in this discharge space. This plasma treatment device is such that plasma generation gas G is supplied to the discharge space, while the pressure inside this discharge space is maintained near atmospheric pressure, and when the pair of discharge electrodes 11 are further applied with voltage and a voltage exceeding the discharge starting voltage is applied to generate discharge in the discharge space, atmospheric-pressure plasma P will generate in the discharge space.

Under the present invention, the plasma ejection port is intended, after inks of multiple colors have been printed, to simultaneously cure these multiple inks all together.

A plasma ejection port for performing this atmospheric-pressure plasma irradiation may be provided, in the case that the multi-color serial head method is adopted, on the same head as an inkjet nozzle on the downstream side relative to the movement of the target base printing material, or it may be provided separately from the inkjet head so that it can be moved, etc., as desired. Also, a plasma ejection port that ejects atmospheric-pressure plasma may be provided as one piece with an inkjet nozzle of the line head method.

Under both the serial head method and the line head method, a configuration in which a plasma ejection port is provided on the same head as the inkjet nozzle is possible, where inkjet nozzles for two or more given colors are provided on the same head as a plasma ejection port, and one or more such heads are installed. Also, inkjet nozzles N assigned to multiple colors, respectively, may be provided on the same head as plasma ejection ports 21, as shown in FIG. 2-1. For example, a plasma ejection port 21 for each color may be provided on the downstream side of a nozzle N for each of CMYK colors, as shown in FIG. 2-2.

Furthermore, as shown in FIG. 2-3, a plasma ejection port 21 may be provided downstream of multiple CMYK inkjet nozzles so that printing with these inkjet nozzles can be followed by a single treatment with atmospheric-pressure plasma P. While FIG. 2-3 shows a combination of inkjet nozzles for four colors and an atmospheric-pressure plasma ejection port downstream thereof, inkjet nozzles for two colors may be combined with an atmospheric-pressure plasma ejection port provided downstream thereof. For the inkjet ink provided upstream of one plasma ejection port, two or more types of inks that vary in color, ink characteristics, etc., may also be selected.

It should be noted that the layouts shown in FIGS. 2-2 and 2-3 can be provided under both the serial head method and the line head method.

Here, the basic structure of the line head method is one where, as shown in FIG. 2-4 as a view from diagonally below, multiple inkjet nozzles N and plasma ejection ports 21 are provided above the target base printing material S in a manner extending across the width direction of the target base printing material.

Furthermore, a cover C for covering each plasma ejection port 21 may be provided and the plasma ejection port may be provided in a manner oriented into the cover so as to increase the concentration of atmospheric-pressure plasma in the ambience inside the cover.

Also, the atmospheric-pressure plasma used under the present invention includes all gases resulting from the plasma modification of material gases.

When each plasma ejection port itself is provided between or near inkjet printing nozzles for different colors and moves with these nozzles as one piece, it will irradiate atmospheric-pressure plasma onto inks immediately after they have been printed, and therefore one that irradiates atmospheric-pressure plasma over a range of preferably 1 to 10 mm, or more preferably 1 to 5 mm, in diameter may be adopted.

During printing, the inkjet nozzles may be moved back and forth with respect to the surface of the target base printing material. In this case, a nozzle that ejects atmospheric-pressure plasma may be provided for each set, and between sets, of nozzles assigned to multiple colors, among the inkjet nozzles for multi-color printing. Furthermore, not only between the color-specific nozzles, but nozzles that eject atmospheric-pressure plasma may also be provided, one each, on the outer sides (outer sides in the width direction of the target base printing material) of the nozzles positioned at both ends of the arranged color-specific nozzles.

Similarly, when inkjet nozzles are provided based on the line head method, a plasma ejection port may be provided in such a way that it can eject atmospheric-pressure plasma onto multiple colored inks after the multiple colored inks have been printed.

FIG. 3-1 is a cross-sectional view of the device in FIG. 2-1 as viewed from side. In FIG. 3-1, the plasma ejection port 21 is provided in such a way that atmospheric-pressure plasma will be ejected in the same direction as the inkjet nozzle N. A device having this structure can still print and cure inks sufficiently. It should be noted that a cover C for covering the plasma ejection port 21 may be provided.

However, cured inks must not collect at the opening part of the inkjet nozzle N due to the atmospheric-pressure plasma ejected from the plasma ejection port 21 that ejects atmospheric-pressure plasma. Accordingly, the atmospheric-pressure plasma to be ejected from the plasma ejection port 21 that ejects atmospheric-pressure plasma must be ejected from the plasma ejection port 21 for atmospheric-pressure plasma which is provided in a manner described in A or B below, so that it will contact uncured inks deposited on the surface of the target base printing material S but will not contact the inkjet nozzle N:

A. As shown in FIG. 3-2, the plasma ejection port 21 that ejects atmospheric-pressure plasma is placed on the upstream side, in the moving direction of the target base printing material S, of the inkjet nozzle N, at a position as close or closer to the target base printing material S as/than the inkjet nozzle N so that atmospheric-pressure plasma will be ejected in the same direction as the moving direction of the target base printing material. And, the plasma ejection port 21 that ejects atmospheric-pressure plasma can be provided in a manner oriented to eject atmospheric-pressure plasma onto inks that have just been printed but no longer have the position relationship of facing the inkjet nozzle N because the inkjet nozzle N has moved.

B. As shown in FIG. 3-3, the plasma ejection port 21 that ejects atmospheric-pressure plasma is placed on the downstream side, in the moving direction of the target base printing material S, of the inkjet nozzle N, at a position as close or closer to the target base printing material S as/than the inkjet nozzle N so that atmospheric-pressure plasma will be ejected in the opposite direction to the moving direction of the target base printing material. And, the plasma ejection port 21 that ejects atmospheric-pressure plasma can be provided in a manner oriented to eject atmospheric-pressure plasma onto inks that have just been printed but no longer have the position relationship of facing the inkjet nozzle N because the inkjet nozzle N has moved.

If the device in FIG. 3-2 or FIG. 3-3 above is adopted, atmospheric-pressure plasma can be irradiated immediately after an ink having a given color has deposited on the target base printing material according to the movement of the inkjet nozzle N and discharge of the colored ink. Also, because atmospheric-pressure plasma does not contact the inkjet nozzle N, the cured ink does not deposit/collect on the inkjet nozzle N.

In the cases of FIG. 3-2 and FIG. 3-3 above, atmospheric-pressure plasma can be irradiated on each colored ink at a timing immediately after its ejection and before the next colored ink is ejected.

As a result, the next colored ink, when ejected, will not mix with the previous colored ink whose surface has already been cured to some degree by atmospheric-pressure plasma, and consequently the printed outlines will become clearer.

It should be noted that, in other inkjet printing devices, ink jet nozzles N for all colors used in printing may be provided on the print head and multiple plasma ejection ports 21 corresponding to the respective colors may also be provided on the same head, as shown in FIG. 2-1 to FIG. 2-4. Alternatively, inkjet nozzles for multiple colors representing only a part of colors such as three or four colors may be provided on one head together with a plasma ejection port(s) 21 for curing these colored inks. Or, one or more such heads may be provided along with heads that each represent a different ink color, so that, as a whole, inks of all colors can be ejected and the surface of the respective inks will be cured with plasma.

(Plasma Ejection Port (Provided Separately from Inkjet Nozzle))

Under the present invention, the plasma ejection port may be provided separately from the inkjet nozzle head. In this case, one or more heads, each printing only one color, will be placed along the moving direction of the target base printing material. Alternatively, one or more plasma ejection devices will be provided on the downstream side of a head or heads combining multiple colors.

In FIG. 4, the inkjet nozzle N ejects only one colored ink. If multi-color printing is performed, as many such inkjet nozzles N as the number of necessary colors are to be provided downstream of the arrow representing the moving direction of the target base printing material S. FIG. 4 is a drawing that shows only one of these colors, and the inkjet nozzle N is provided at a position facing the backup roller R provided as necessary.

After the first colored ink has been printed by this inkjet nozzle N, the target base printing material is conveyed to a plasma treatment device 40 similar to the plasma treatment device shown in FIG. 1. Here, a plasma treatment device comprising a discharge space, into which atmospheric-pressure plasma generation gas G is introduced, and which has an ejection port and is formed by an insulator body 42, as well as a pair of discharge electrodes 41 that are facing each other over a spacing of approx. 0.5 to 5.0 mm to generate an electric field in this discharge space, is used. This plasma treatment device is such that plasma generation gas G is supplied to the discharge space, while the pressure inside this discharge space is maintained near atmospheric pressure, and a voltage is further applied to the pair of discharge electrodes 41, and when a voltage exceeding the discharge starting voltage is applied to generate discharge in the discharge space, atmospheric-pressure plasma P will generate in the discharge space.

And, the generated atmospheric-pressure plasma P travels through a plasma ejection tube 43 and is irradiated on the ink on the target base printing material. Here, a cover 45 may be provided to increase the concentration of atmospheric-pressure plasma inside the cover 45.

When inkjet printing is performed based on the line head method, a plasma treatment device may be provided for, and on the downstream side of, each head conforming to the line head method and used for printing one colored ink, or a plasma treatment device may be provided for, and on the downstream side of, each head used for printing two or more colored inks. And, a plasma treatment device may be provided on the downstream side of the foregoing so that, once all colored inks have been printed, atmospheric-pressure plasma can be ejected onto all of the colored inks.

Also, a backup roller 44 may be provided on the side of the target base printing material S opposite to the plasma ejection tube 43, where this roller is grounded or an electric charge opposite to that carried by the atmospheric-pressure plasma is applied to it, so that atmospheric-pressure plasma will exist on the surface of the target base printing material S at high concentration.

It should be noted that FIG. 5 shows a device that ejects atmospheric-pressure plasma using an atmospheric-pressure plasma introduction tube 103 and a nozzle 102 provided at its tip and thereby treats the ink on a target base printing material 104 on rollers 105. Such device constitution may be adopted with the plasma ejection tube 43 fixed, wherein the plasma ejection tube is designed as a slit-like nozzle opening part so that the moving target base printing material can be treated over its entire width.

Alternatively, in FIG. 4, the movement, in the width direction of the target base printing material, of the inkjet nozzle N capable of printing multiple colored inks may be delayed by the time it takes for the target base printing material to move from the inkjet nozzle N to the plasma treatment device 40, while the plasma ejection tube 43 is moved in the same manner as the inkjet nozzle N, so that atmospheric-pressure plasma will be irradiated primarily on the ink printed by the inkjet nozzle N.

And, although this is not illustrated, the aforementioned printing with an inkjet ink using the inkjet nozzle N shown in FIG. 4, and surface curing of the printed ink using the plasma treatment device 40, are considered as a set representing one plasma treatment device per each of multiple colored inks, and such sets are provided in the same number as the colors required for overall printing.

In FIG. 4, a front-end atmospheric-pressure plasma treatment device 30 may be provided upstream of the inkjet nozzle N. This front-end plasma treatment device 30 is used to plasma-treat the surface of the target base printing material prior to printing. As a result of such treatment by the plasma treatment device 30, plasma species still remain on the surface of the target base printing material at the time of printing. This means that, when inkjet printing is performed using the inkjet nozzle N, these groups charged by plasma treatment will remain and allow the interior of the printed ink to cure slightly after printing.

For the front-end plasma treatment device 30 that shares a common basic constitution with the plasma treatment device 40, a plasma treatment device comprising a discharge space, into which atmospheric-pressure plasma generation gas G is introduced, and which has an ejection port and is formed by an insulator 32, as well as a pair of discharge electrodes 31 that are facing each other over a spacing of approx. 0.5 to 5.0 mm to generate an electric field in this discharge space, is used.

This plasma treatment device is such that plasma generation gas G is supplied to the discharge space, while the pressure inside the discharge space is maintained near atmospheric pressure, and a voltage is further applied to the pair of discharge electrodes 31, and when a voltage exceeding the discharge starting voltage is applied to generate discharge in the discharge space, atmospheric-pressure plasma P will generate in the discharge space.

And, the generated atmospheric-pressure plasma P travels through a plasma ejection tube 33 and irradiates the ink on the target base printing material. Here, a cover 35 may be provided to increase the concentration of atmospheric-pressure plasma inside the cover 35.

Also, a backup roller 34 may be provided on the side of the target base printing material S opposite to the plasma ejection tube 33, where this backup roller is grounded or an electric charge opposite to that carried by the atmospheric-pressure plasma is applied to it, so that atmospheric-pressure plasma will exist on the surface of the target base printing material S at high concentration.

(Installation of Device for Grounding or Charging)

For each inkjet nozzle and/or nozzle that ejects atmospheric-pressure plasma, a backup roller or bar that supports the non-printing surface of the target base printing material may be provided at a position facing the nozzle via the target base printing material. And, this backup roller or bar may be grounded or charged to the polarity opposite to the polarity of the plasma particles beforehand, so that an electric charge that attracts atmospheric-pressure plasma and improves the plasma density at the ink surface on the target base printing material can be applied to cause the plasma ejected from the plasma ejection port to change its direction and hit the ink on the target base printing material.

Also, a small cover may be provided in a manner enclosing the plasma ejection port and uncured ink on the target base printing material, so that plasma can be ejected into the cover to cause the plasma present inside the cover to move toward the top of the target base printing material.

By keeping air flows containing plasma from directly blowing against the ink, as described above, the possibility of individual ink dots or their outlines spreading as a result of air flows blowing against the uncured ink on the target base printing material can be reduced.

Also, by providing such backup roller or bar, the density of atmospheric-pressure plasma can be lowered simultaneously in the ambience of the inkjet nozzle and its surroundings. As a result, depositing/collection of cured ink on the inkjet nozzle can be prevented.

(Atmospheric-Pressure Plasma Irradiation Device)

For the plasma irradiation device that supplies plasma to the plasma ejection port, a remote atmospheric-pressure plasma irradiation device may be adopted. Plasma is a high-energy gas that generates when discharge is caused by applying high voltage between electrodes. Atmospheric-pressure plasma is a type of plasma generated under atmospheric pressure, and normally used for such purposes as hydrophilizing the surfaces of material.

For such device, a plasma treatment device comprising a discharge space with an outlet, as well as discharge electrodes facing each other over a spacing of approx. 0.5 to 5.0 mm to generate an electric field in this discharge space, like the one shown in FIG. 1, for example, is used. This plasma treatment device is such that plasma generation gas G is supplied to the discharge space, while the pressure inside the discharge space is maintained near atmospheric pressure, and a voltage is further applied to the discharge electrodes 11, and when a voltage exceeding the discharge starting voltage is applied to generate discharge in the discharge space, plasma will generate in the discharge space.

The target base printing material can be plasma-treated by blowing against it this atmospheric-pressure plasma P jetted from the ejection port. For such plasma irradiation device, the RT series or APT series manufactured by Sekisui Chemical Co., Ltd., any appropriate plasma treatment device offered by Yamato Material Co., Ltd., or the like, or any of plasma irradiation devices used with the devices described in Japanese Patent Laid-open No. 2004-207145, Japanese Patent Laid-open No. Hei 11-260597, and Japanese Patent Laid-open No. Hei 3-219082, may also be used.

Also, for the gases used for atmospheric-pressure plasma, air, oxygen, nitrogen, etc., may be adopted.

It should be noted that the aforementioned spacing between the electrodes depends on the applied voltage, and a high-frequency, pulse-wave, microwave or other electric field is applied to the electrodes to generate plasma.

Above all, preferably pulse waves are applied in consideration of the fact that the time needed for an electric field to rise and fall (rise and fall refer to voltage increasing and decreasing continuously) is preferably short. Here, the time needed for an electric field to rise and fall is preferably 10 μs or shorter, or more preferably 50 ns to 5 μs.

The electric field intensity that generates between the electrodes in the plasma irradiation device is 1 kV/cm or higher or preferably 20 kV/cm or higher, and/or no higher than 1000 kV/cm or preferably no higher than 300 kV/cm.

Also, when an electric field is applied using pulse waves, their frequency is preferably 0.5 kHz or higher, but it may be around 10 to 20 MHz, or around 50 to 150 MHz.

Furthermore, the electric power applied between the electrodes is 40 W/cm or lower, or preferably 30 W/cm or lower.

It is better that the aforementioned electrodes do not come in direct contact with the gas, in order to achieve stable plasma discharge. For this reason, desirably the electrode surface is coated or otherwise covered with an insulating film using any known means. Such insulating film may be quartz, alumina, or other glass material, or ceramic material, for example. Depending on the situation, barium titanate, silicon oxide, aluminum nitride, silicon nitride, silicon carbide, or other dielectric body with a dielectric constant of 2000 or lower may also be adopted.

A remote atmospheric-pressure plasma irradiation part such as those discussed above is one, for example, comprising an atmospheric-pressure plasma irradiation part, a unit including a plasma ejection tube, etc., and a power supply part, among the aforementioned known devices. Based on the above device, multiple parts that eject atmospheric-pressure plasma may further be arranged in their width direction, or each nozzle may further be shaped as a slit, in order to treat the target base printing material uniformly in the width direction.

A schematic view of a cross-section of such remote atmospheric-pressure plasma irradiation part is shown in FIG. 1. In FIG. 1, a gas G to be turned into plasma passes between a pair of electrodes 11, one of which is grounded, and which have a layer made of an insulator body 12, etc., formed on their surface, and as it passes, the gas G is turned into plasma by the voltage applied between the electrodes. While FIG. 1 shows an air flow containing atmospheric-pressure plasma P directly contacting the printed surface of the target base printing material S, the atmospheric-pressure plasma need not make direct contact.

It should be noted that the atmospheric-pressure plasma ejected from the nozzle that ejects atmospheric-pressure plasma may irradiate beforehand the printing surface of the target base printing material to be supplied to the inkjet nozzle, on the upstream side of the inkjet nozzle. This allows the atmospheric-pressure plasma to remain briefly on the printing surface of the target base printing material, so that inkjet printing can be performed while the plasma still remains. As a result, the ink that has deposited on the surface of the target base printing material can be cured, albeit slightly, at the deposited part.

<Electron Beam Irradiation Part>

The function of the electron beam irradiation part under the present invention is to act on the colored inks whose surface has been cured by the irradiation of atmospheric-pressure plasma on the upstream thereof, either concurrently with inkjet printing or after inkjet printing, using the plasma ejection port provided as one piece with the inkjet nozzle, or plasma ejection port provided separately from the inkjet nozzle, and completely cure the inks internally and externally in their entirety. Adopting the electron beam irradiation part as described above, in combination with the adoption of atmospheric-pressure plasma ejection, eliminates the need for the inkjet ink composition to contain a polymerization initiator or related auxiliary agents, etc. Furthermore, high-contrast images can be formed without causing the boundaries of adjacent colors to smudge.

As for the electron beam generation device that constitutes the electron beam irradiation part, any known device may be adopted.

And, an introduction/irradiation device for irradiating the electron beam generated by the electron beam generation device, over the ink on the target base printing material, is provided.

Also, the ambience in which to irradiate the electron beam is preferably one of nitrogen, rare gas, or other inert gas, in the interest of facilitating the curing.

And, the target base printing material must be passed through the electron beam irradiation part in such a way that the electron beam generated by this electron beam generation device will be irradiated uniformly over the ink on the surface of the target base printing material. Inside the electron beam irradiation part, for example, the electron beam can be irradiated on the printing surface of the target base printing material in a manner irradiating in the shape of a curtain. It should be noted that an appropriate level of the acceleration voltage of electron beam, which can be changed in a timely manner according to the specific gravity and film thickness of the ink, is 20 to 300 kV. Preferably the irradiation quantity of electron beam is in a range of 0.1 to 20 Mrad.

Such electron beam irradiation part, in combination with the irradiation of atmospheric-pressure plasma, can cure energy beam-curable inkjet printing inks. Furthermore, there is no need to compound any polymerization initiator, curing agent, auxiliary polymerization initiation agent, etc., in the inks beforehand. The inks can be cured sufficiently without having to compound these components into the ink.

Examples

By supplying a polyethylene terephthalate film of 21 cm in width to a line-type inkjet printing device so that a printing speed of 12 m/min would be achieved, each of the compositions of Examples and Comparative Examples as shown in Table 1 below was printed and then cured under the respective conditions shown in Table 1. In the table, the compounding quantities of compositions are expressed in mass.

It should be noted that the examples where "Y" is indicated in "Plasma curing between colors with gas species N2" are examples where an atmospheric-pressure plasma whose gas species was nitrogen gas was irradiated from a slit of 300 mm in width at a gas flow rate of 30 L/min on the inkjet printing ink of each color after the entire color had been printed. "Y" in "EB irradiation, 30 kGray, 90 kV" indicates that, after all colors had been printed, an electron beam generated at a voltage of 90 kV was irradiated on the ink to 30 kGray in a nitrogen gas-purged ambience.

(Removal of Coating Film)

Using a Gakushin-type rubbing tester (manufactured by Daiei Kagaku Seiki Mfg. Co., Ltd.), the cured coating film surface was rubbed by moving a friction element, for which unbleached muslin No. 3 was used, back and forth 200 times over it with a 500-g load, and the coating film was evaluated for removal.

○: The coating film was not removed.

Δ: The coating film was slightly removed.

X: The coating film was removed.

(Tackiness)

○: When the coating film surface was touched with a finger, no tackiness was found on the coating film surface.

X: When the coating film surface was touched with a finger, tackiness was found on the coating film surface.

Pigment dispersant: Solsperse 39000 (manufactured by Lubrizol Corporation)

PO-modified NPGDA: Propoxylated modified (2) tripropylene glycol diacrylate (SR492, manufactured by Sartomer Co., Inc.)

EO(3)-modified trimethylolpropane triacrylate: (SR354, manufactured by Sartomer Co., Inc.)

TPO: 2,4,6-trimethylbenzoyl diphenyl phosphine oxide (manufactured by Lamberti S.p.A)

Irgacure 184 (manufactured by BASF SE)

DETX: 2,4-diethyl thioxanthone (manufactured by Lambson Ltd.)

BYK333: Silicone additive (manufactured by BYK-Chemie GmbH)

TABLE 1

| | Examples | | | | | | | Comparative Examples | | | | |
|---|---|---|---|---|---|---|---|---|---|---|---|---|
| | 1 | 2 | 3 | 4 | 5 | 6 | 7 | 1 | 2 | 3 | 4 | 5 |
| Pigment Blue 15:4 | 2.0 | | | | 2.0 | | | 2.0 | | 2.0 | 2.0 | 2.0 |
| Pigment Red 122 | | 3.6 | | | | | | | 3.6 | | | |
| Pigment Yellow 180 | | | 2.4 | | | | | | | | | |
| Carbon black | | | | 1.2 | | | | | | | | |
| Pigment dispersant: Solsperse 39000 | 0.8 | 1.4 | 1.0 | 0.5 | 0.8 | | | 0.8 | 1.4 | 0.8 | 0.8 | 0.8 |
| Self-dispersive cyan dispersion Pig. 20% | | | | | | | 10.0 | | | | | |
| Benzyl acrylate | 10.2 | 16.0 | 14.6 | 7.3 | 10.2 | 12.0 | | 10.2 | 16.0 | 10.2 | 10.2 | 10.2 |
| 4-hydroxybutyl acrylate | 12.0 | 12.0 | 12.0 | 12.0 | 12.0 | 12.0 | 16.0 | 12.0 | 12.0 | 12.0 | 12.0 | 12.0 |
| PO-modified NPGDA | 20.0 | 12.0 | 15.0 | 24.0 | 11.0 | 11.0 | | 20.0 | 12.0 | 11.0 | 20.0 | 20.5 |
| EO(3)-modified trimethylolpropane triacrylate | 10.0 | 10.0 | 10.0 | 10.0 | 10.0 | 20.0 | 5.5 | 10.0 | 10.0 | 10.0 | 10.0 | 10.0 |
| Phenoxyethyl acrylate | 10.0 | 10.0 | 10.0 | 10.0 | 10.0 | 10.0 | | 10.0 | 10.0 | 10.0 | 10.0 | 10.0 |
| Isobornyl acrylate | 24.5 | 24.5 | 24.5 | 24.5 | 24.5 | 24.5 | | 24.5 | 24.5 | 24.5 | 24.5 | 24.5 |
| Vinyl caprolactam | 10.0 | 10.0 | 10.0 | 10.0 | 10.0 | 10.0 | | 10.0 | 10.0 | 10.0 | 10.0 | 10.0 |
| Acryloyl morpholine | | | | | | | 15.0 | | | | | |
| PEG400 diacrylate | | | | | | | 20.0 | | | | | |
| RO membrane-purified water | | | | | | | 33.0 | | | | | |
| TPO | | | | | 6.0 | | | | | 6.0 | | |
| Irgacure 184 | | | | | 2.0 | | | | | 2.0 | | |
| DETX | | | | | 1.0 | | | | | 1.0 | | |
| BYK333 | 0.5 | 0.5 | 0.5 | 0.5 | 0.5 | 0.5 | 0.5 | 0.5 | 0.5 | 0.5 | 0.5 | |
| Total | 100 | 100 | 100 | 100 | 100 | 100 | 100 | 100 | 100 | 100 | 100 | 100 |
| Plasma curing between colors with gas species N2 | Y | Y | Y | Y | Y | Y | Y | N | N | N | Y | N |
| EB irradiation, 30 kGray, 90 kV | Y | Y | Y | Y | Y | Y | Y | Y | Y | Y | N | Y |
| Removal of coating film | ○ | ○ | ○ | ○ | ○ | ○ | ○ | Δ | Δ | Δ | x | Δ |
| Tackiness | ○ | ○ | ○ | ○ | ○ | ○ | ○ | ○ | ○ | ○ | x | ○ |

According to Table 1 above, plasma-treating each color after that color had been printed, prevented the coating film from exhibiting tackiness and being removed even when rubbed with unbleached muslin No. 3, as is evident from the Examples. When plasma was not irradiated after printing, on the other hand, the coating film was slightly removed.

Also, when plasma was irradiated but EB was not, printing manifested some removal of the coating film and tackiness.

TABLE 2

| | Example 8 | Comparative Example 6 | Comparative Example 7 |
|---|---|---|---|
| | The inks used in Example 1, Example 2, Example 3 and Example 4 were inkjet-printed successively. | | |
| Plasma curing between colors with gas species N2 | ○ | x | ○ |

TABLE 2-continued

| | Example 8 | Comparative Example 6 | Comparative Example 7 |
|---|---|---|---|
| | The inks used in Example 1, Example 2, Example 3 and Example 4 were inkjet-printed successively. | | |
| EB irradiation 30 kGray, 90 kV | ○ | ○ | x |
| Removal of coating film | ○ | Δ | x |
| Tackiness | ○ | ○ | x |

Table 2 shows that Example 8, where plasma treatment and EB irradiation were performed successively only after a successive inkjet printing of four colored inks, achieved printing free from removal of the coating film or tackiness.

By contrast, Comparative Example 6, where plasma irradiation was not performed, resulted in removal of the coating film, while Comparative Example 7 where EB curing was not performed resulted in removal of the coating film as well as poor outcome in terms of tackiness.

According to the Examples above, the device proposed by the present invention can achieve printing free from removal of the coating film or tackiness.

What is claimed is:

1. An inkjet printing device, which is for multi-color printing, comprising:

multi-color inkjet nozzles that move in a direction perpendicular to a moving direction of a target base printing material and also in a direction parallel to a surface of the target base printing material, while printing on the target base printing material;

plasma ejection ports provided downstream of the multi-color inkjet nozzles in the moving direction of the target base printing material in a manner oriented facing a surface of multiple colored inks printed on the target base printing material, wherein an opening part of each plasma ejection port is oriented in a manner that a plasma ejected from the opening part of the plasma ejection port is set to be oriented toward a direction opposite the moving direction of the target base printing material; and an electron beam irradiation part located on a downstream side of the multi-color inkjet nozzles and plasma ejection ports in the moving direction of the target base printing material, in a manner oriented facing the printed surface of the target base printing material.

2. The inkjet printing device according to claim 1, comprising:

an inkjet printing part comprising:

the multi-color inkjet nozzles, and the plasma ejection ports installed independently of the inkjet nozzles; and the electron beam irradiation part located on a downstream side, in the moving direction of the target base printing material, of the inkjet printing part.

3. The inkjet printing device according to claim 2, wherein a head equipped with each of multi-color inkjet nozzles has the plasma ejection port on a downstream side of the inkjet nozzle in the moving direction of the target base printing material.

4. The inkjet printing device according to claim 3, wherein the head is constituted for each inkjet nozzle assigned to each color, and a head having the plasma ejection port is provided downstream of each head having such inkjet nozzle assigned to each color.

5. The inkjet printing device according to claim 2, wherein a head is constituted for each inkjet nozzle assigned to each color, and a head having the plasma ejection port is provided downstream of each head having such inkjet nozzle assigned to each color in the moving direction of the target base printing material.

6. The inkjet printing device according to claim 2, wherein a base material that is grounded or charged with negative electricity or positive electricity is placed, under the inkjet printing part, on a side of a non-printing surface opposite to the printing surface of the target base printing material in a manner contacting the non-printing surface side of the target base printing material when the target base printing material moves under the inkjet printing part.

7. The inkjet printing device according to claim 2, having a cover for covering the plasma ejection port.

8. The inkjet printing device according to claim 2, further comprising:

a cover provided for covering the inkjet printing part, wherein the plasma ejection port is provided in the cover.

9. The inkjet printing device according to claim 8, wherein a base material that is grounded or charged with negative electricity or positive electricity is placed, in the inkjet printing part, on an opposite side of the target base printing material as viewed from the plasma ejection port, and in contact with the non-printing surface side of the target base printing material.

10. The inkjet printing device according to claim 1, comprising:

a inkjet printing part comprising the multi-color inkjet nozzles;

the plasma ejection port provided on the downstream side, in the moving direction of the target base printing material, of the inkjet printing part; and the electron beam irradiation part located on the downstream side, in the moving direction of the target base printing material, of the plasma ejection port.

11. The inkjet printing device according to claim 10, wherein a base material that is grounded or charged with negative electricity or positive electricity is placed on the opposite side of the target base printing material as viewed from the plasma ejection port and in contact with the non-printing surface side of the target base printing material.

12. The inkjet printing device according to claim 10, having a cover for covering the plasma ejection port.

13. The inkjet printing device according to claim 1, wherein the opening part of each plasma ejection port is oriented in a manner that the plasma is ejected from the opening part of the plasma ejection port at an acute angle relative to a plane perpendicular to the moving direction of the target base printing material.

* * * * *